US010173312B2

(12) United States Patent
Franssen

(10) Patent No.: US 10,173,312 B2
(45) Date of Patent: Jan. 8, 2019

(54) ARCHITECTURAL COVERING WITH REPOSITIONABLE HANDLE ASSEMBLY

(71) Applicant: Hunter Douglas Industries B.V., Rotterdam (NL)

(72) Inventor: Johannes Robertus Maria Franssen, Breda (NL)

(73) Assignee: Hunter Douglas Industries B.V., Rotterdam (NL)

( * ) Notice: Subject to any disclaimer, the term of this patent is extended or adjusted under 35 U.S.C. 154(b) by 0 days.

(21) Appl. No.: 14/380,580

(22) PCT Filed: Feb. 27, 2013

(86) PCT No.: PCT/NL2013/000012
§ 371 (c)(1),
(2) Date: Aug. 22, 2014

(87) PCT Pub. No.: WO2013/129918
PCT Pub. Date: Sep. 6, 2013

(65) Prior Publication Data

US 2015/0013921 A1 Jan. 15, 2015

(30) Foreign Application Priority Data

Feb. 28, 2012 (NL) ..... 2008369

(51) Int. Cl.
*E06B 9/262* (2006.01)
*B25G 3/00* (2006.01)
(Continued)

(52) U.S. Cl.
CPC ..... *B25G 3/00* (2013.01); *E06B 9/262* (2013.01); *E06B 9/30* (2013.01); *E06B 9/322* (2013.01);
(Continued)

(58) Field of Classification Search
CPC . Y10T 16/455; Y10T 16/4559; Y10T 16/462; Y10T 16/4644; Y10T 16/4652;
(Continued)

(56) References Cited

U.S. PATENT DOCUMENTS 1,892,087 A 12/1932 Stuber
2,624,906 A 1/1953 Foster
(Continued)

FOREIGN PATENT DOCUMENTS

EP 1353037 A2 10/2003

OTHER PUBLICATIONS

PCT International Search Report dated Jun. 21, 2013 for International Application No. PCT/NL2013/000012, 3 pages.
U.S. Appl. No. 15/414,801, filed Jan. 25, 2017.

*Primary Examiner* — Katherine W Mitchell
*Assistant Examiner* — Jeremy C Ramsey

(57) ABSTRACT

An architectural covering, comprising a rail and a repositionable handle assembly. The rail has a groove. The assembly comprises a handle with a hole for receiving a fastener, and a fastener receiving member. The fastener receiving member is free to slide along the groove when in an undamped state. A fastener is also provided for mechanically connecting the handle to the fastener receiving member and for clamping the handle and the fastener receiving member in a desired position on the rail.

26 Claims, 6 Drawing Sheets

(51) Int. Cl.

| | |
|---|---|
| ***E06B 9/388*** | (2006.01) |
| ***E06B 9/30*** | (2006.01) |
| ***E06B 9/322*** | (2006.01) |
| ***E06B 9/38*** | (2006.01) |

(52) U.S. Cl.
CPC ..... *E06B 9/38* (2013.01); *E06B 9/388* (2013.01); *E06B 2009/2625* (2013.01); *Y10T 16/44* (2015.01)

(58) Field of Classification Search
CPC . Y10T 16/469; Y10T 16/444; E06B 9/17046; E06B 2009/3222; E06B 9/78; E06B 9/74; B25G 3/00; B25G 3/06; B25G 3/08; B25G 3/04; A47B 95/02; A47B 2095/024; E05B 1/00; E05B 1/0038; E05B 2001/0023; E05B 1/0046; E05B 1/0015
USPC ..... 160/405, 84.01–84.05, 178 R, 178.1 R, 160/290.1, 384; 403/240, 247, 257–259
See application file for complete search history.

(56) References Cited

U.S. PATENT DOCUMENTS

| | | | | |
|---|---|---|---|---|
| 2,865,044 | A | 12/1958 | Bielek | |
| 2,987,021 | A * | 6/1961 | Meier | D05B 73/00 112/258 |
| 3,470,764 | A * | 10/1969 | Frymire | E06B 7/084 49/87.1 |
| 3,581,798 | A | 1/1971 | Malamed | |
| 3,692,155 | A * | 9/1972 | Laurita | 16/114.1 |
| 4,687,041 | A | 8/1987 | Anderson | |
| 4,831,678 | A * | 5/1989 | Dietsche | B25G 3/08 15/106 |
| 4,884,615 | A * | 12/1989 | Hsu | E06B 9/386 160/236 |
| 4,911,348 | A * | 3/1990 | Rasor | B60R 9/045 211/94.01 |
| 5,265,307 | A * | 11/1993 | Hull et al. | 16/406 |
| 5,937,929 | A | 8/1999 | Chen | |
| 6,356,503 | B1 * | 3/2002 | Roy | 365/230.06 |
| 6,536,503 | B1 * | 3/2003 | Anderson | E06B 9/262 160/170 |
| 7,175,377 | B2 * | 2/2007 | Womack et al. | 410/104 |
| 7,389,565 | B2 | 6/2008 | Cheng | |
| 7,802,608 | B2 | 9/2010 | Anderson et al. | |
| D647,777 | S | 11/2011 | Franssen | |
| 8,899,545 | B2 * | 12/2014 | Blees | B64C 1/20 244/118.1 |
| 2002/0157796 | A1 | 10/2002 | Judkins | |
| 2002/0174961 | A1 | 11/2002 | Anderson et al. | |
| 2004/0131439 | A1 | 7/2004 | Womack et al. | |
| 2007/0084567 | A1 * | 4/2007 | Chen | 160/84.05 |
| 2008/0115894 | A1 * | 5/2008 | Cech et al. | 160/168.1 V |
| 2009/0106942 | A1 * | 4/2009 | Dell'orfano | 16/425 |
| 2012/0097349 | A1 | 4/2012 | Chen | |
| 2012/0227912 | A1 | 9/2012 | Anderson et al. | |
| 2012/0267056 | A1 | 10/2012 | Ko | |
| 2014/0076504 | A1 | 3/2014 | Anthony et al. | |
| 2014/0216666 | A1 | 8/2014 | Smith et al. | |
| 2015/0020982 | A1 | 1/2015 | Anderson et al. | |
| 2015/0034262 | A1 | 2/2015 | Franssen | |
| 2015/0197984 | A1 | 7/2015 | Anderson et al. | |
| 2015/0259978 | A1 | 9/2015 | Lin et al. | |
| 2016/0010389 | A1 | 1/2016 | Anderson et al. | |

* cited by examiner

ARCHITECTURAL COVERING WITH REPOSITIONABLE HANDLE ASSEMBLY

CROSS-REFERENCE TO RELATED APPLICATIONS

This application is the national stage application of International Patent Application No. PCT/NL2013/000012, filed Feb. 27, 2013, entitled "Architectural Covering With Repositionable Handle Assembly", which claims priority to Netherlands Patent Application No. 2008369, filed Feb. 28, 2012, entitled "Architectural Covering With Repositionable Handle Assembly," which are hereby incorporated by reference herein in their entireties.

BACKGROUND OF THE INVENTION

The invention relates to an architectural covering, in particular an architectural covering having at least one rail that may be manually adjusted so as to extend or retract a covering member of the architectural covering.

Architectural coverings are well-known and include roller blinds, venetian blinds, plissé blinds, roman shades, etc. Such coverings can be extended across the whole or part of an architectural opening such as a window or door, or retracted to uncover the whole or part of said opening. One type of covering, known as a top-down/bottom-up covering, includes a first rail and a second rail with shade material extending between the rails. Both rails may be independently moved up and down so that the shade material can be extended or retracted to any desired degree between the two rails and also positioned at any desired height across the architectural opening. When the rails are moved towards each other, the shade material is gathered between the two rails and when the rails are separated, the shade material extends between the rails.

Such coverings may be retracted and extended via various operating systems, which may be manually and/or motor driven. Some coverings may be operated by manually pushing the or each rail up or down a guiding system. To facilitate such operation, the rails may be provided with a handle.

The handle is generally screwed onto the rail. Although this provides a simple and effective handle, it has numerous disadvantages. Firstly, a hole needs to be drilled at the position where the handle is desired, which makes the installation process more difficult. Secondly, if the hole tears or is otherwise damaged, it will be necessary to drill another hole and relocate the handle, which requires further installation work. Furthermore, the damaged hole will be visible on the rail, reducing the aesthetic appeal of the covering. Thirdly, if a customer wants to change the position of the handle, he must drill another hole and the original hole will be left visible. Again, this requires further installation work and results in an unsightly hole being visible on the rail.

SUMMARY

The handle assembly of the architectural covering according to the present invention aims to overcome these disadvantages.

To this end the invention provides an architectural covering as defined in one or more of the appended claims.

DESCRIPTION OF THE DRAWINGS

The present invention will now be described with reference to the drawings in which.

DETAILED DESCRIPTION

Figure 1:
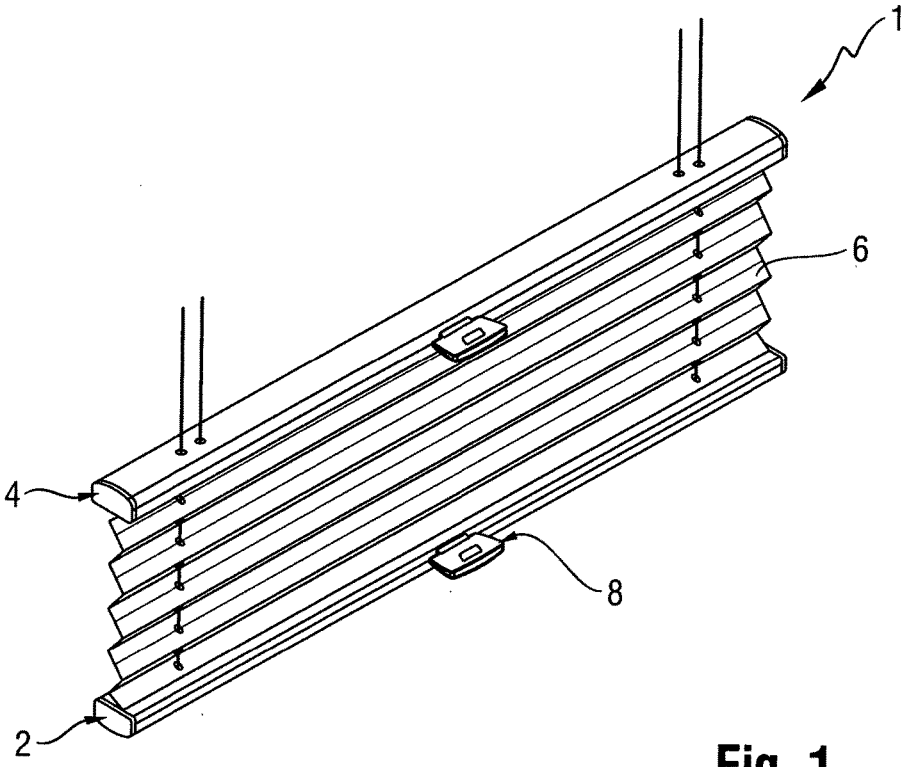
FIG. 1 is an isometric external view of an architectural covering according to the invention, with a repositionable handle assembly.

Referring to FIG. 1, an architectural covering 1 having a bottom rail 2, a top rail 4 and a covering member 6 extending between these rails 2,4 is illustrated. The top edge of the covering member 6 is secured to the top rail 4. The top rail 4 can be raised or lowered relative to a head rail (not shown). As the top rail 4 is raised, the covering member 6 is extended to cover more of the window. As the top rail 4 is lowered, the covering member 6 is retracted to uncover more of the window. Similarly, the bottom edge of the covering member 6 is secured to the bottom rail 2, and the bottom rail 2 can be raised or lowered to extend or retract the covering member 6. Accordingly, the covering member 6 can be extended or retracted to any desired degree between the two rails 2, 4. The top and bottom rail can be independently positioned at any desired location relative to each other. To facilitate manual movement of the top rail and the bottom rail, a handle 8 is provided on each rail.

Figure 2:
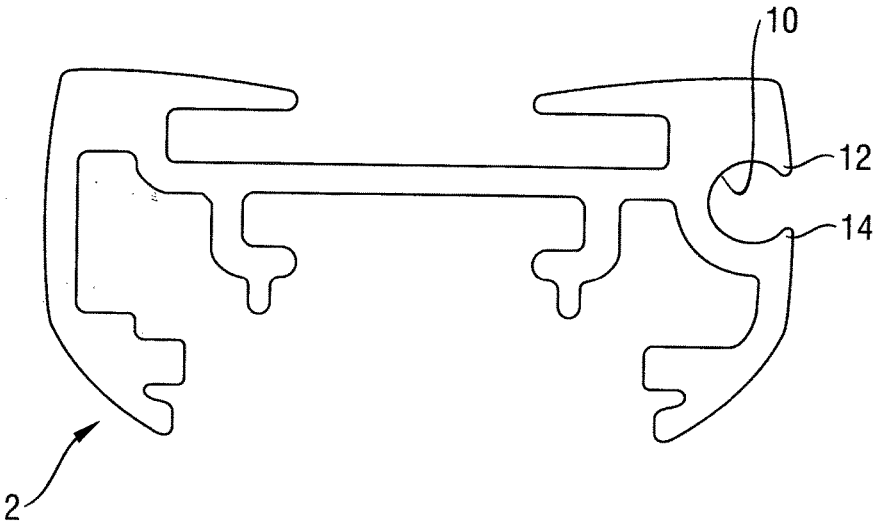
FIG. 2 is a cross section of the rail of the architectural covering shown in FIG. 1.
Figure 3:
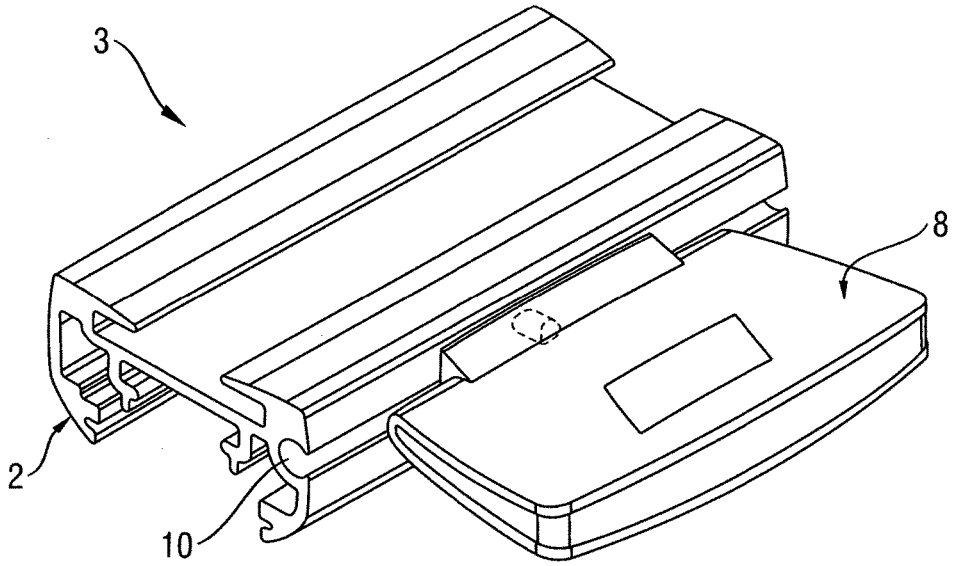
FIG. 3 shows a fragmentary isometric view of a first embodiment of a repositionable handle assembly according to the present invention.
Figure 4:
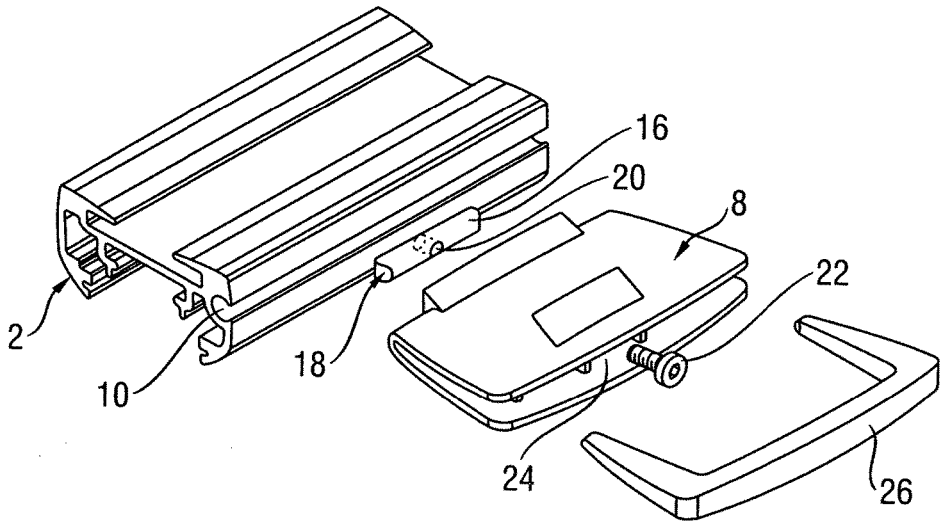
FIG. 4 shows an exploded view of the fragmentary isometric view shown in FIG. 3.

FIG. 2 shows a cross section through the bottom rail 2. In this example, the top rail 4 and the bottom rail 2 have an identical cross section. Of course, the top rail and the bottom rail may alternatively have dissimilar cross sections. The covering member 6 is secured to and disposed within the rail, but this is not shown in FIG. 2 for clarity. A groove 10 is provided on an external surface of the rail. The groove extends along the longitudinal length of the rail and is provided with lips 12, 14. In the illustrated embodiments, the groove 10 is shown as being substantially cylindrical but other shapes such as a square shape, rectangular shape, elliptical shape or other shape are also possible.

A first embodiment of the repositionable handle assembly of the present invention is shown in FIGS. 3 to 7. The handle assembly 3 includes a cylindrically shaped fastener receiving member 16 for sliding into the groove 10. The fastener receiving member 16 may be inserted into the groove 10 at either of the longitudinal ends of the groove 10 and, when in an unclamped state, the fastener receiving member 16 is free to slide along the length of the groove 10. The lips 12, 14 of the groove 10 prevent the fastener receiving member 16 from falling out of the groove 10. A fastener receiving member 16 has a hole 20 bored through it. The hole is for receiving a fastener 22. In this example, the fastener 22 is a screw and the hole 20 has internal screw threading such that it can receive the screw 22. In an alternative embodiment, the fastener 22 may for instance be a rivet.

The handle assembly 3 further includes a handle 8. The handle 8 incorporates a hole 24 which extends through the handle 8 and which is for receiving the fastener 22. In use, the fastener receiving member 16 is inserted into the groove 10 and slid along until it reaches the desired position. Screw 22 is then inserted into hole 24 of the handle and extends through the handle 8 into the hole 20 on the fastener receiving member 16. When the fastener 22 is tightened partially, the handle 8 and the fastener receiving member 16 will be clamped together by the screw, but the fastening receiving member 16 will still be free to slide in the groove 10. The fastener receiving member 16 and attached handle 8 can then be slid along the groove 10 into the position desired by the user and the fastener 22 can then be tightened such that it clamps handle 8 and fastening receiving member firmly to the rail 2. When fastener 22 is tightened sufficiently, the handle 8 and fastener receiving member 16 can no longer slide within the groove. A snap on cover 26 is provided for snapping over the outer edge of the handle 8 such that it covers the hole 24 and fastener 22. This increases the aesthetic appeal of the handle.

Figure 5:
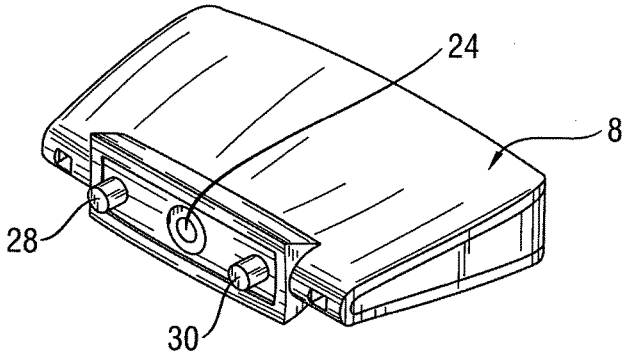
FIG. 5 is an isometric view of the handle of the first embodiment of the present invention.

FIG. 5 shows the rear part of the handle 8 in more detail. The hole 24 which runs through the handle 8 can be seen, as well as two projections 28, 30. The spacing between projections 28, 30 is such that the fastener receiving member can be disposed between them. In this example, the projections 28, 30 are of cylindrical shape. The longitudinal ends 18 of fastener receiving member 16 are designed to have a complementary shape to the projections 28, 30 such that the projections 28, 30 fit snugly into the shaped longitudinal ends 18 of the fastener receiving member 16. In this example, there are cylindrical grooves formed on both longitudinal ends 18 of the fastener receiving member 16, which complement the cylindrical projections 28, 30. Of course, other complementary shapes may be used for the projections 28, 30 and longitudinal ends 18 of the fastener receiving member 16.

In use, the projections 28, 30 extend into the groove on either side of the fastener receiving member 16 and act to hold the fastener receiving member 16 in position whilst the fastener 22 is tightened. Otherwise, the fastener receiving member might rotate or move relative to the handle 8 making it difficult to insert the fastener 22.

Figure 6:
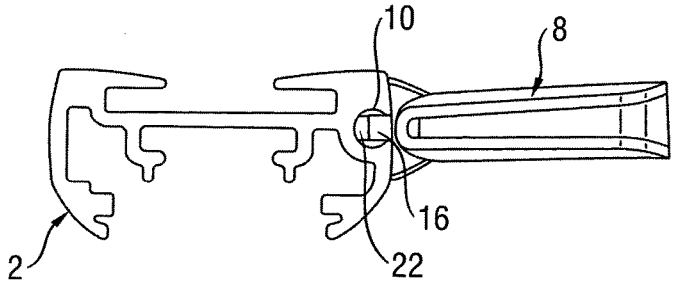
FIG. 6 is a cross section through the rail and handle of the first embodiment showing the handle in a clamped position.
Figure 7:
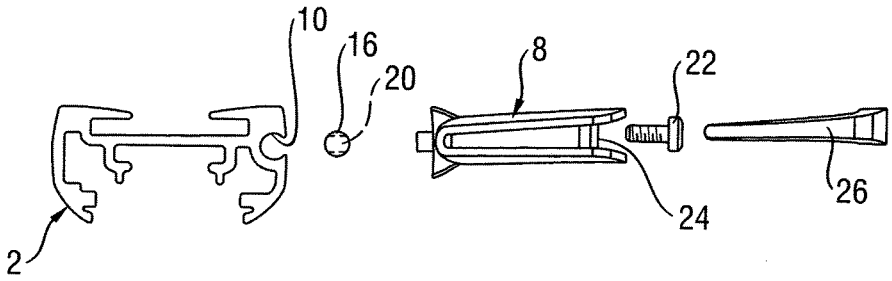
FIG. 7 is an exploded view of the handle and rail shown in FIG. 6.

FIG. 6 shows a cross section through the bottom rail 2 with the handle 8 clamped in position on the rail. As can be seen in FIGS. 5 and 6, the fastener receiving member 16 is inserted into the groove 10 and the handle 8 is clamped to the fastener receiving member 16 using the screw 22. The screw 22 is inserted into the hole 24 in the handle 8 and extends through the handle into the hole 20 of the fastener receiving member 16.

Once the handle 8 is firmly attached to the top rail 2, the handle 8 may be used to pull up or push down the top rail 2. Top rail 4 may also be provided with a similar handle assembly for allowing the rail 4 to be pushed up or pulled down as required. It can be seen that the top rail and the bottom rail can be moved independently of each other. This allows the user to easily position each rail and to thereby control the extent to which the architectural opening is covered and to control the location of the covering.

Although the cover 26 is described in this example as being a snap on cover, it will be apparent that other types of cover such as a slide on cover or a flip up cover, for example, may be used instead. Ideally the cover should be easy to operate and should increase the aesthetic appeal of the handle, by shielding the fastener and associated hole from view.

Figure 8:
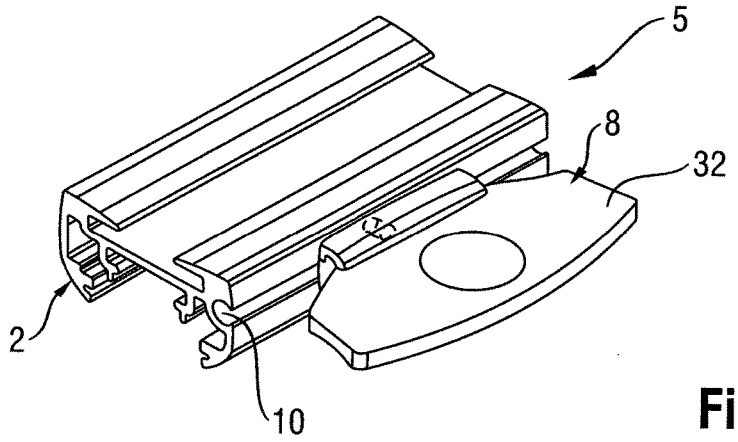
FIG. 8 shows a fragmentary isometric view of a second embodiment of the present invention.
Figure 9:
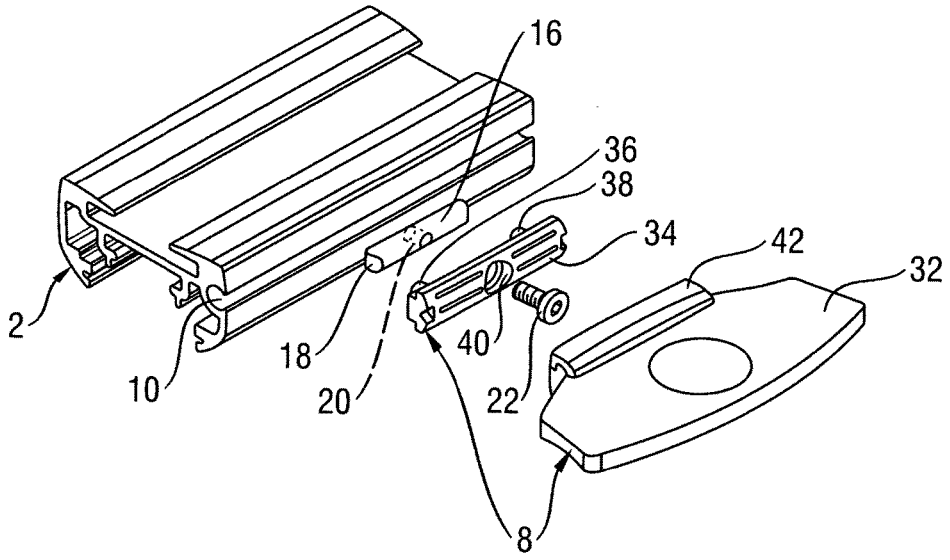
FIG. 9 shows an exploded view of the handle and rail shown in FIG. 8.
Figure 10:
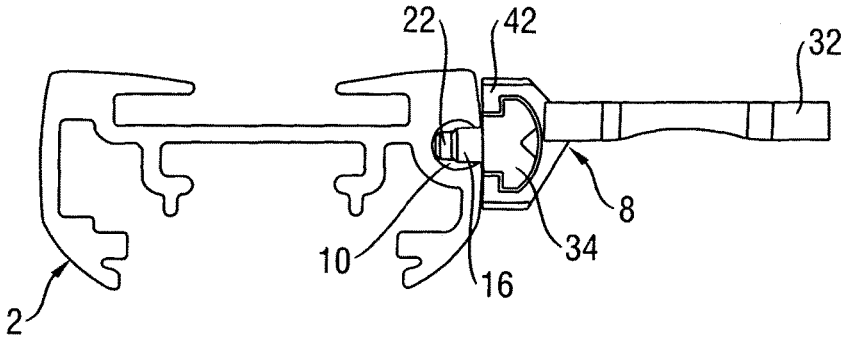
FIG. 10 shows a cross section through the handle and rail assembly of FIGS. 8 and 9, showing the handle clamped in position on the rail.
Figure 11:
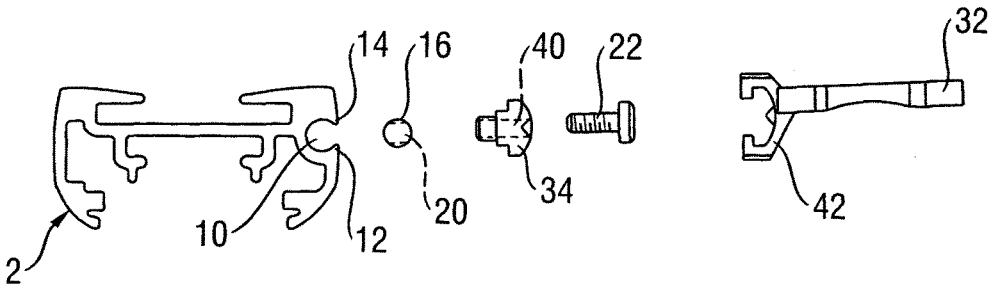
FIG. 11 shows an exploded view of the handle assembly shown in FIG. 10.

A second embodiment of the repositionable handle assembly of the present invention is shown in FIGS. 8 to 11. FIG. 8 shows a bottom rail 2. A groove 10 having lips 12, 14 extends along the external surface of the rail 2. The repositionable handle assembly 5 can be seen in more detail in FIGS. 9 to 11. As in the previous embodiment a fastener receiving member 16, with a hole 20 extending through it, is provided for inserting into the groove 10. In this embodiment however, the handle 8 comprises two parts, an auxiliary part 34 and a gripping part 32. The auxiliary part 34 has a hole 40 extending through it for receiving the fastener 22. The auxiliary part 34 has projections 36, 38 extending from its rear surface. These projections are similar to, and fulfill the same function as, the projections 28, 30 of the first embodiment. Again, the longitudinal ends 18 of the fastener receiving member 16 are designed to have a shape complimentary to the projections 36, 38. In use, the fastener receiving member 16 is inserted into the groove 10. The auxiliary part 34 is positioned such that the hole 40 of the auxiliary part 34 and the hole 20 of the fastener receiving member 16 are aligned. The fastener 22 is then inserted into the hole 40 of the auxiliary part 34 and tightened into hole 20 of the fastener receiving member 16. The auxiliary part 34 and the fastener receiving member 16 are now connected together by fastener 22 but are free to slide within the groove 10. The user can now slide the auxiliary part 34 along the groove 10 until the auxiliary part 34 is in a desired position. The fastener 22 is then tightened to securely clamp the auxiliary part 34 and the fastener receiving member 16 in a fixed position on the rail 2. The gripping part 32 of the handle 8 may now be attached to the auxiliary part 34. A connecting portion 42 is provided as part of the gripping part 32 of the handle 8 for allowing the gripping part 32 to be attached to the auxiliary part 34. The connecting portion 42 may be slid over the auxiliary part 34 or may be snap fitted into position on the auxiliary part 34. The gripping part 32 of the handle covers up the auxiliary part 34, its hole 40 and the fastener 22. This increases the aesthetic appeal of the handle assembly 5 and also the associated window covering 1.

It will be seen that this second embodiment permits the gripping part 32 of the handle 8 to be rapidly changed. This allows a user to quickly remove and replace the handle if, for example, the handle becomes broken or if the user requires a different shaped handle or a handle of a different colour. Furthermore, the gripping part 32 of the handle 8 may be designed to be small and slender as its size and shape is not constrained by any need to accommodate the fastener 22.

In both of these embodiments, it can be seen that the handle may easily be repositioned along the length of the groove 10 without the need for drilling and without leaving behind any unsightly holes. To reposition the handle, the user simply needs to unsnap the cover 26 (in the first embodiment) or remove the gripping part 32 of the handle 8 (in the second embodiment), untighten the screw 22 so that the fastener receiving member 16 may be slid along the groove to the desired new position, and then the screw 22 can be retightened, thereby clamping the handle 8 firmly in a new desired position. The cover 26 or gripping part 32 can then be snapped or slid back into position.

Figure 12:
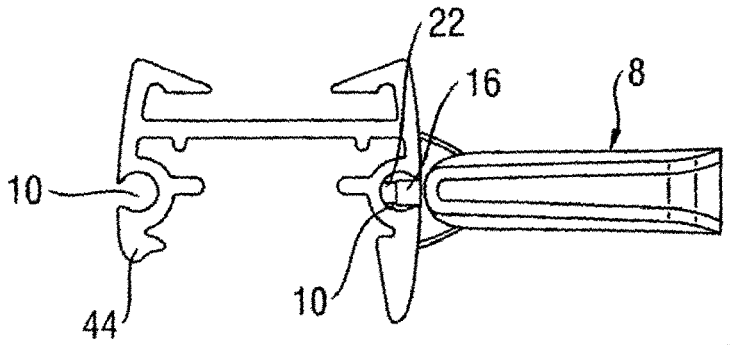
FIG. 12 shows a cross section through a repositionable handle assembly having a rail of different cross section to previous examples.
Figure 13:
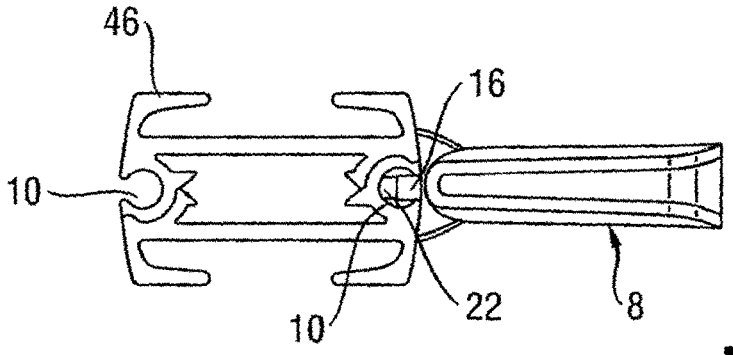
FIG. 13 similarly shows a cross section through a repositionable handle assembly having a rail of different cross section to the previous examples.
Figure 14:
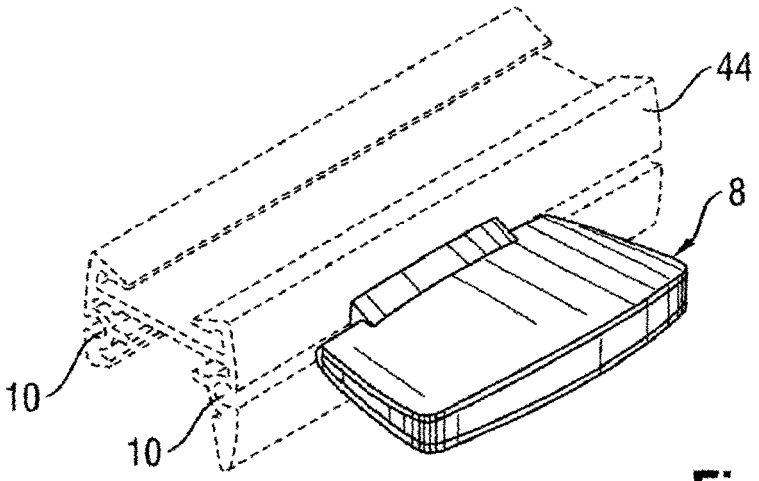
FIG. 14 shows a fragmentary isometric view of the handle assembly of FIG. 12.

FIGS. 12 and 13 each show a cross section through a rail 44, 46, respectively, the rails 44, 46 both having a different cross sectional shape to the rails 2, 4 shown in the previous figures. In so far as the repositionable handle assembly is concerned, it does not matter what cross sectional shape the rails 44, 46 have. However, a groove 10 still needs to be provided in an external surface of the rail for allowing a fastener receiving member 16 to be positioned within the groove 10. The rail 44 of FIG. 12 and the rail 46 of FIG. 13 both have two grooves 10, a groove being located on each side of the rail. The handle 8 may be positioned in whichever of the grooves the user desires. The user could have two handles, one positioned on either side of the rail, if he so wishes. FIGS. 1 to 11 by contrast show a groove 10 located on one side only of the rail 2. When a groove 10 is only provided on one side of the rail 2, the window covering may be turned the other way around so that the rail 2 presents a uniform groove free surface. The handle 8 may be also removed if this is no longer required. This affords the user more flexibility.

In the illustrated embodiments, the groove 10 and fastener receiving member 16 both have a complementary cylindrical shape. Of course, other complementary shapes are possible. Similarly, the projections 28, 30, 36, 38 on the handle 8 are shown as being cylindrical, as are the grooves in the longitudinal ends 18 of the fastener receiving member 16. The projections on the handle and the grooves in the longitudinal ends of the fastener receiving member may of course take other complementary shapes.

In these examples, the fastener receiving member 16 is inserted into the groove 10 by a user. It is alternatively envisaged that the fastener receiving member 16 may be already located in the groove 10 prior to purchase of the window covering 1 by the user.

The handle assembly has been described with respect to its use in a top-down/bottom-up window blind. This handle assembly can of course be used on bottom-up or top-down only blinds, or in blinds which have rails which are adapted to move horizontally across an architectural opening, rather than vertically up and down. The architectural opening may be a window, or a door, or any other type of architectural opening. The blind may also include a ball chain or a motor for operating the rail, in combination with the handle described in the present invention, so that the user can decide whether to operate the blind by manipulating the rail manually or by using a ball chain or a motor.

The covering member 6 disposed between the rails 2,4 may be a pleated material, as shown. Many alternatives are possible. For instance, the covering member 6 can be made from elongated cells, slats or vanes, which may be interconnected via cords and/or a front sheet, and/or a rear sheet. These cells, slats, vanes and/or sheets, may be made of fabric, paper, non-wovens, plastic, wood, etc.

The invention claimed is:

1. An architectural covering comprising:

a covering member that can be extended and retracted;

a rail that is operatively connected to the covering member; and at least one repositionable handle assembly;

wherein:

the rail is provided with a groove on an external surface of the rail; and the at least one repositionable handle assembly comprises:

a handle having a hole for receiving a fastener;

a fastener receiving member for insertion into the groove, the fastener receiving member being free to slide along the groove when in an unclamped state;

a fastener for mechanically connecting the handle to the fastener receiving member and for clamping the handle and the fastener receiving member in a desired position along the rail; and a cover selectively coupled to the handle to shield the hole and the fastener from view, the cover being separate from the fastener.

2. The architectural covering as claimed in claim 1, wherein the fastener is a screw.

3. The architectural covering as claimed in claim 1, wherein the handle further comprises at least two projections adapted to be located in the groove, the projections being spaced sufficiently apart to allow the fastener receiving member to be located entirely between the projections.

4. The architectural covering as claimed in claim 3, wherein the fastener receiving member has both its longitudinal ends shaped to accommodate the projections on the handle.

5. The architectural covering as claimed in claim 1, wherein the handle comprises an auxiliary part and a gripping part, the auxiliary part having the hole for receiving the fastener and the gripping part being adapted to be releasably attached to the auxiliary part.

6. The architectural covering as claimed in claim 1, wherein the rail is provided with two grooves extending at opposite sides of the rail.

7. The architectural covering as claimed in claim 1, wherein the rail comprises a first rail, and further comprising a second rail operatively connected to the covering member opposite the first rail.

8. The architectural covering as claimed in claim 1, wherein the covering member comprises plissé fabric.

9. The architectural covering as claimed in claim 1, wherein the cover is a snap on cover.

10. The architectural covering as claimed in claim 9, wherein the cover snaps over an edge of the handle.

11. The architectural covering as claimed in claim 1, wherein:

the fastener receiving member has a length and a width; and the length of the fastener receiving member is greater than the width of the fastener receiving member.

12. The architectural covering of claim 1, wherein the fastener receiving member defines a hole therethrough for receiving the fastener, the hole positioned equidistant between the longitudinal ends of the fastener receiving member.

13. The architectural covering of claim 1, wherein the handle is disposed entirely along a front or rear side of the rail.

14. An architectural covering comprising:

a movable rail on said covering, said moveable rail defining a groove, the groove including a longitudinal axis; and a handle assembly repositionably coupled to the rail along an axis that is parallel to the longitudinal axis of the groove, the handle assembly being configured to be secured at a selected one of multiple positions along a length of the groove and comprising:

a fastener receiving member received at least partially within the groove; and a flattened handle coupled to the fastener receiving member by a fastener;

wherein the handle shields the fastener from view when the handle assembly is coupled to the rail such that the fastener is not viewable by a user during use; and wherein the handle comprises a removable cover or gripping part that shields the fastener from view when the handle assembly is coupled to the rail.

15. The architectural covering of claim 14, wherein the handle is elongated in a longitudinal direction of the rail.

16. The architectural covering of claim 14, wherein:

the handle comprises an auxiliary part, the auxiliary part including a hole for receiving the fastener; and the gripping part is releasably coupled to the auxiliary part.

17. The architectural covering of claim 16, wherein the gripping part covers the auxiliary part, the hole, and the fastener when the handle is coupled to the rail.

18. The architectural covering of claim 14, wherein manipulation of the handle assembly moves the rail to extend or retract the architectural covering.

19. An architectural covering comprising:

a rail on said covering, said rail defining a groove; and a handle assembly repositionably coupled to the rail and comprising:

a handle including at least two projections adapted to be located within the groove of the rail;

a fastener receiving member received at least partially within the groove of the rail and positioned between the at least two projections of the handle, the fastener receiving member including a hole; and a fastener having a first unsecured end and a second unsecured end when said fastener is not received within the hole, the fastener configured to be received within the hole for connecting the handle to the fastener receiving member;

wherein the handle shields the fastener and the fastener receiving member from view when the handle is coupled to the rail.

20. The architectural covering of claim 19, wherein:

the fastener is operable to clamp the handle and the fastener receiving member in a desired position along the rail; and the fastener receiving member is free to slide along the groove when the fastener receiving member is in an unclamped state.

21. The architectural covering of claim 19, wherein the fastener receiving member is positioned entirely between the at least two projections of the handle.

22. The architectural covering of claim 19, further comprising a covering member that can be extended and retracted, the rail being operatively connected to the covering member.

23. The architectural covering of claim 19, wherein the handle includes a removable cover or gripping part that shields the fastener from view when the handle assembly is coupled to the rail.

24. The architectural covering of claim 19, wherein the handle includes a gripping part and an auxiliary part, the auxiliary part including a second hole, the hole formed in the fastener receiving member and the second hole formed in the auxiliary part being aligned with one another to receive the fastener.

25. The architectural covering of claim 24, wherein the auxiliary part includes the at least two projections.

26. The architectural covering of claim 24, wherein the handle is operatively coupled to the auxiliary part.

* * * * *